US005400304A

United States Patent [19]

Offenstein

[11] Patent Number: 5,400,304

[45] Date of Patent: Mar. 21, 1995

[54] ORNAMENTAL CLOCK

[75] Inventor: Beate Offenstein, Kolsass, Austria

[73] Assignee: D. Swarovski & Co., Wattens, Austria

[21] Appl. No.: 74,211

[22] Filed: Jun. 9, 1993

[30] Foreign Application Priority Data

Jun. 9, 1992 [DE] Germany ..... 42 18 874.1

[51] Int. Cl.[6] ..... G04B 19/10

[52] U.S. Cl. ..... 368/285; 368/294; 368/296; 368/281

[58] Field of Search ..... 368/294–296, 368/281, 282

[56] References Cited

U.S. PATENT DOCUMENTS 4,362,397 12/1982 Klingenberg ..... 368/233
4,473,306 9/1984 Lederrey ..... 368/296

FOREIGN PATENT DOCUMENTS 340189 9/1959 Switzerland ..... 368/285
429600 7/1967 Switzerland ..... 368/285

*Primary Examiner*—Bernard Roskoski
*Attorney, Agent, or Firm*—Fay, Sharpe, Beall, Fagan, Minnich & McKee

[57] ABSTRACT

The invention relates to an ornamental clock having a clock glass with gems glued to the underside of the clock glass with transparent adhesive.

3 Claims, 1 Drawing Sheet

ORNAMENTAL CLOCK

Figure 1:
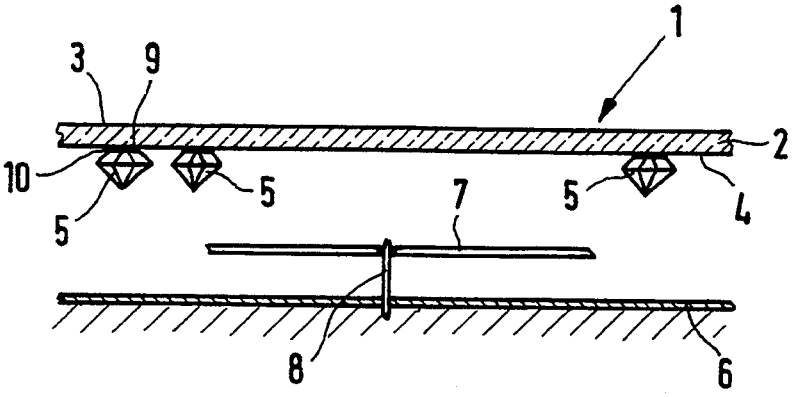

The present invention relates to an ornamental clock having a clock case decorated by gems.

It is known to provide clock cases with gems to give clocks a special aesthetic appearance. The gems are frequently mounted on the circumference of the clock glass or the clock case. It is also known to fasten such gems to the surface of the clock glass. The disadvantage is that these gems are exposed on the outside of the clock case and therefore not protected from being damaged and soiled. Mechanical action frequently causes them to be detached and lost.

It is also known to provide the faces of clocks with gems. Although these gems are then protected from dirt and mechanical action, the disadvantage is that the effect of the gems is considerably reduced by the clock glass spaced therefrom.

The problem on which the present invention is based is to provide clocks, i.e. clock cases, with gems in such a way that their aesthetic effect is not affected but they are still protected from being damaged, soiled or even lost.

The invention is based on the finding that this problem can be solved by mounting the gems under the clock glass.

The object of the invention is an ornamental clock having a clock glass with gems glued to the underside of the clock glass with transparent adhesive.

Gems used to decorate a clock in this way lose none of their original aesthetic effect but are, on the contrary, both optimally accessible to the eye of the beholder and mounted with optimal protection. Mounting the gems on the underside of the clock glass protects them from being soiled and lost while retaining their complete ornamental effect for the clock.

The gems are preferably cut glass stones. Incident light cut glass stones show particular brilliance through the spectral decomposition of the light. Special sparkling and color effects are created. Cut glass stones are normally very sensitive to breakage and damage so that mounting them on the underside of the clock glass is particularly advantageous.

In further preferred embodiments the glass stones are vaporized with a metal layer whereby the metal layer can be brightly colored. However the glass stones are preferably given a silvery coat.

It is also preferable to use colored glass stones.

In a further preferred embodiment the gems are disposed on the circumference of the underside of the clock glass in accordance with the manner of hour numbering. They thereby offer a particularly decorative orientation aid for reading the clock. In a further preferred embodiment the gems can be disposed on the underside of the clock glass in the form of a figured motif. The possibilities of designing the ornamental clock are thus unlimited.

According to a preferred embodiment the transparent adhesive used is a polyacrylate adhesive that does not impair the optical effect of the gems. A firm bond between the gem and the clock glass is ensured.

The inventive design of the ornamental clock is preferably used in conjunction with wrist watches. The watch strap can be included in the decorative design with the gems. For example the gems can also be glued to the watch strap assembled into figured motifs.

Figure 2:
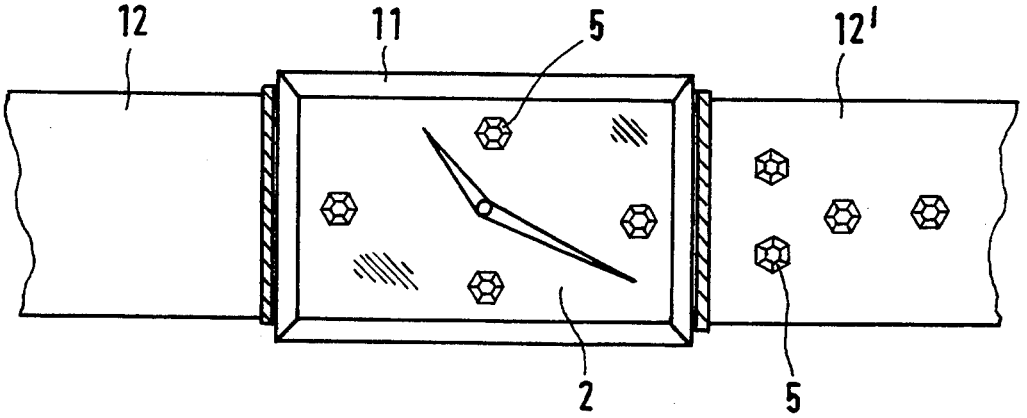

The invention shall be explained in more detail in the following with reference to drawings, in which FIG. 1 shows a cross section through a clock case of an inventive ornamental clock;

FIG. 2 shows a front view of a watch according to the invention.

FIG. 1 is a schematic cross section through a clock case of the inventive ornamental clock. It shows face 6 and clock glass 2 disposed thereabove. Pair of hands 7 is mounted on face 6 via shaft 8. Gems 5 are mounted on underside 4 of clock glass 2. The gems are glued via their visible side 9 to underside 4 of clock glass 2 with transparent adhesive 10.

FIG. 2 shows a front view of a watch according to the invention. Clock case 11, which is rectangular here, is held by two watch straps 12, 12'. Gems 5 which are glued to the underside of clock glass 2 are located at 12, 3, 6 and 9 o'clock in the embodiment shown. However the gems can also be used to mark each hour or be assembled into figured motifs. Gems 5 are likewise provided in an ornamental arrangement on watch strap 12'.

The gems used within the framework of the invention can be of any type, in particular semiprecious stones such as zircon. The gems used can also be synthetic stones, e.g. made of polyacryl.

However cut glass stones are preferably used due to their brilliance. Chatons are particularly preferred. These cut glass stones can also be vaporized according to the invention with a metal layer which might be colored. Aluminizing is preferable, however, since the silvery coat can create special esthetic and decorative effects. In the case of chatons they are glued with their visible side to the underside of the clock glass, as shown.

The gems should be relatively small for a wrist watch so that they do not obstruct the path of the hands. A suitable order of magnitude is between 0.5 and 2 mm. The most suitable size has proven to be 1.3 mm. The upper part of the cut glass stone or chaton can possibly be shorter, i.e. the part above the equator can be cut lower than usual.

The adhesive layer between the visible side of the gem and the underside of the clock glass is preferably a layer of polyacrylate adhesive. This layer is preferably extremely thin so as to retain an optimal aesthetic effect of the gem.

The clock glass can be made of a mineral glass customary for clocks or from various layers of mineral glasses customary for clock cases. The clock glass may also be made of an unbreakable artificial glass, for example Plexiglas.

If the ornamental clock is a wrist watch the watch strap can also be made of a great variety of customary materials such as plastic, leather or metal. If the clock is a watch there is the possibility of decorating the watch strap itself with gems as well (FIG. 2).

The inventive design of the ornamental clock retains the aesthetic and optical effects of gems while protecting them in optimal fashion from being soiled and damaged.

I claim:

1. A clock apparatus comprising:

a means for displaying time;

a substantially planar base member;

a substantially planar transparent member spaced from said base member creating an interstitial void therebetween and defining a single continuous smooth surface facing said planar base member;

at least one cut glass stone having as a first flat viewing side a part above an equator cut to be shorter than a part below the equator; and, a transparent adhesive affixing the first flat viewing side of the at least one cut glass stone to said continuous smooth surface of said transparent base member.

2. The clock apparatus according to claim 1 wherein said transparent adhesive is a polyacrylate adhesive.

3. The clock apparatus according to claim 2 wherein said at least one cut glass stone is a chaton ranging in size from about 0.5 mm to about 2.0 mm.

* * * * *